US006752282B2

(12) United States Patent
Brown, Jr. et al.

(10) Patent No.: US 6,752,282 B2
(45) Date of Patent: Jun. 22, 2004

(54) SWING DRIVE ASSEMBLY

(75) Inventors: Robert F. Brown, Jr., Racine, WI (US); Gregory N. Feld, Franklin, WI (US); Carl D. Gilmore, South Milwaukee, WI (US)

(73) Assignee: Bucyrus International, Inc., South Milwaukee, WI (US)

( * ) Notice: Subject to any disclaimer, the term of this patent is extended or adjusted under 35 U.S.C. 154(b) by 456 days.

(21) Appl. No.: 09/968,813

(22) Filed: Oct. 2, 2001

(65) Prior Publication Data

US 2002/0057961 A1 May 16, 2002

Related U.S. Application Data

(60) Provisional application No. 60/237,985, filed on Oct. 5, 2000.

(51) Int. Cl.[7] ..... B66C 23/86

(52) U.S. Cl. ..... 212/247

(58) Field of Search ..... 212/180, 181, 212/247, 253, 292; 74/813 L, 411.5, 410, 724; 188/31; 384/421, 461; 192/69.62

(56) References Cited

U.S. PATENT DOCUMENTS 3,949,881 A * 4/1976 Morrow et al. ..... 212/247
3,954,020 A * 5/1976 West et al. ..... 74/410
3,990,539 A * 11/1976 Marit ..... 184/6.12
4,236,863 A * 12/1980 Baron ..... 414/687
4,307,621 A * 12/1981 Merron ..... 74/421 A
4,582,436 A * 4/1986 Merron ..... 384/593
5,058,753 A * 10/1991 Malik et al. ..... 212/247
6,010,018 A * 1/2000 Pech ..... 212/292

* cited by examiner

*Primary Examiner*—Robert E. Pezzuto
(74) *Attorney, Agent, or Firm*—Quarles & Brady LLP

(57) ABSTRACT

A swing drive assembly for use with a mining shovel having a frame rotatable relative to a base, wherein the swing drive assembly is fixed to the frame and engages a ring gear fixed to the base to rotatably drive the mining shovel frame relative to the mining shovel base. The assembly includes a swing girder having a top wall and bottom wall joined by a back wall. At least one strut having a top end extends upwardly from the top wall, and an attachment point is proximal said strut top end for fixing the swing drive assembly to the frame. At least one attachment point is proximal one end of the top wall, and at least one attachment point is proximal an opposing end of the top wall, wherein the girder is fixable to a mining shovel frame at each of the attachment points. Preferably, each attachment point is fixed to the mining shovel frame with at least one bolt. Most preferably, the swing girder is mounted to the frame, and hangs below the frame to engage the ring gear.

18 Claims, 7 Drawing Sheets

SWING DRIVE ASSEMBLY

CROSS REFERENCES TO RELATED APPLICATIONS

This application claims the priority benefit of U.S. Provisional Patent Application No. 60/237,985 filed on Oct. 5, 2000.

STATEMENT REGARDING FEDERALLY SPONSORED RESEARCH

Not Applicable.

BACKGROUND OF THE INVENTION

This invention relates to mining shovels, and more particularly to a swing drive assembly fixed to a mining shovel frame to rotatably drive the frame relative to a mining shovel base.

A conventional mining shovel generally includes a base supported by ground engaging tracks. The base rotatably supports a frame on which is mounted a housing for protecting mining shovel components, such as power generation equipment, electrical equipment, a dipper hoist, and controls. The frame rotates about a pintle relative to the base. The frame is rotatably driven by one or more swing drives. In a known mining shovel, the swing drive is welded to the frame. Other designs bolt the swing drive directly to the frame.

As the frame rotates relative to the base, it deflects which imposes severe stress on the swing drive. The stress can cause the welds fixing the swing drive to the frame to fail, or the bolts affixing the swing drive to loosen, which results in downtime for the shovel to make repairs. A need exists for a swing drive assembly which does not fail as a result of stresses caused by frame deflection.

SUMMARY OF INVENTION

The present invention provides a swing drive assembly for use with a mining shovel having a frame rotatable relative to a base, wherein the swing drive assembly is fixed to the frame and engages a ring gear fixed to the base to rotatably drive the mining shovel frame relative to the mining shovel base. The assembly includes a swing girder having a top wall and bottom wall joined by a back wall. At least one strut having a top end extends upwardly from the top wall, and an attachment point is proximal said strut top end for fixing the swing drive assembly to the frame. At least one attachment point is proximal one end of the top wall, and at least one attachment point is proximal an opposing end of the top wall, wherein the girder is fixable to a mining shovel frame at each of the attachment points. Preferably, each attachment point is fixed to the mining shovel frame with at least one bolt. Most preferably, the swing girder is mounted to the frame, and hangs below the frame to engage the ring gear.

A general objective of the present invention is to provide a swing drive assembly having a swing girder which can withstand the stresses caused by the mining shovel frame rotating relative to the base. The first, second, and third attachment points define a novel three point mounting system for attaching the swing girder to the frame, and allows the girder to flex with the frame deflections.

Another objective of the present invention is to provide a swing girder which is easily manufactured and fixed to the mining shovel frame. The multipoint mounting system assures alignment, as only three points establish a plane.

Moreover, the multi point mounting system minimizes the amount of machining required prior to assembly to further simplify alignment. Prior art swing girders required machining of the entire perimeter of the girder abutting the frame. A three point mounting system only requires machining the mounting pads at each attachment point.

Yet another objective of the present invention is to reduce shafting and bearing loading. This objective is accomplished by hanging a portion of the swing drive assembly below the frame and supporting the pinion shafts on both sides of the pinion. Hanging a portion of the swing drive assembly below the frame requires a shorter pinion shaft which can be straddle mounted, thus reducing shafting and bearing loading.

The foregoing and other objects and advantages of the invention will appear from the following description. In the description, reference is made to the accompanying drawings which form a part hereof, and in which there is shown by way of illustration a preferred embodiment of the invention.

DETAILED DESCRIPTION OF THE PREFERRED EMBODIMENT

Figure 1:
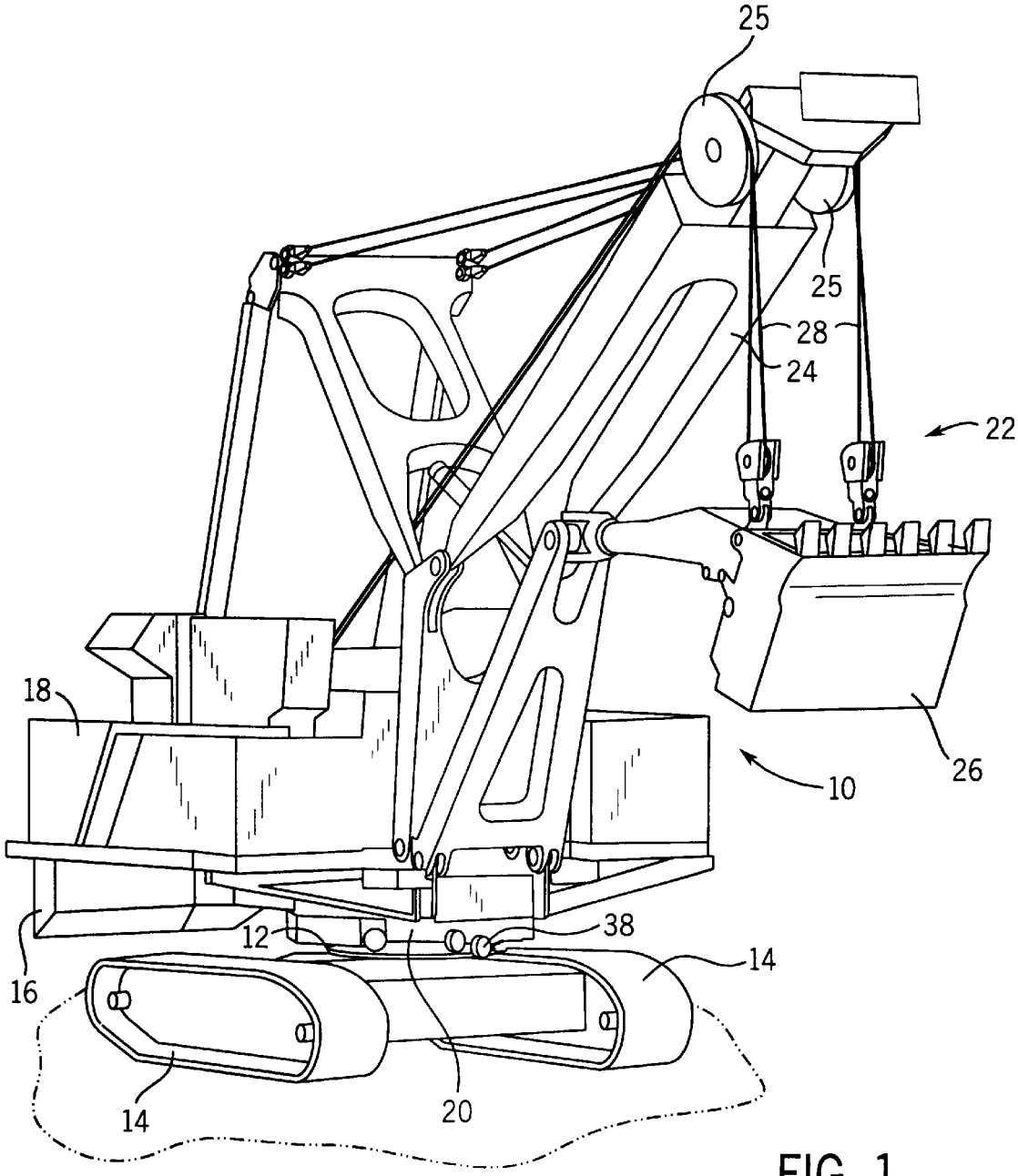
FIG. 1 is a perspective view of a mining shovel incorporating the present invention.

A knee-action mining shovel 10, shown in FIG. 1, includes a base 12 supported by ground engaging tracks 14. The base 12 rotatably supports a frame 16 on which is mounted a housing 18 for protecting mining shovel components, such as power generation equipment, electrical equipment, dipper hoist, and controls. The frame 16 also supports a dipper assembly 22 and overhead boom 24. The dipper assembly 22 is pivotally connected to the frame 16, and supports a dipper 26 for engaging the ground. The overhead boom 24 extends over the dipper assembly 22, and supports hoist rope sheaves 25 which guide hoist ropes 28 attached to the dipper 26.

Figure 2:
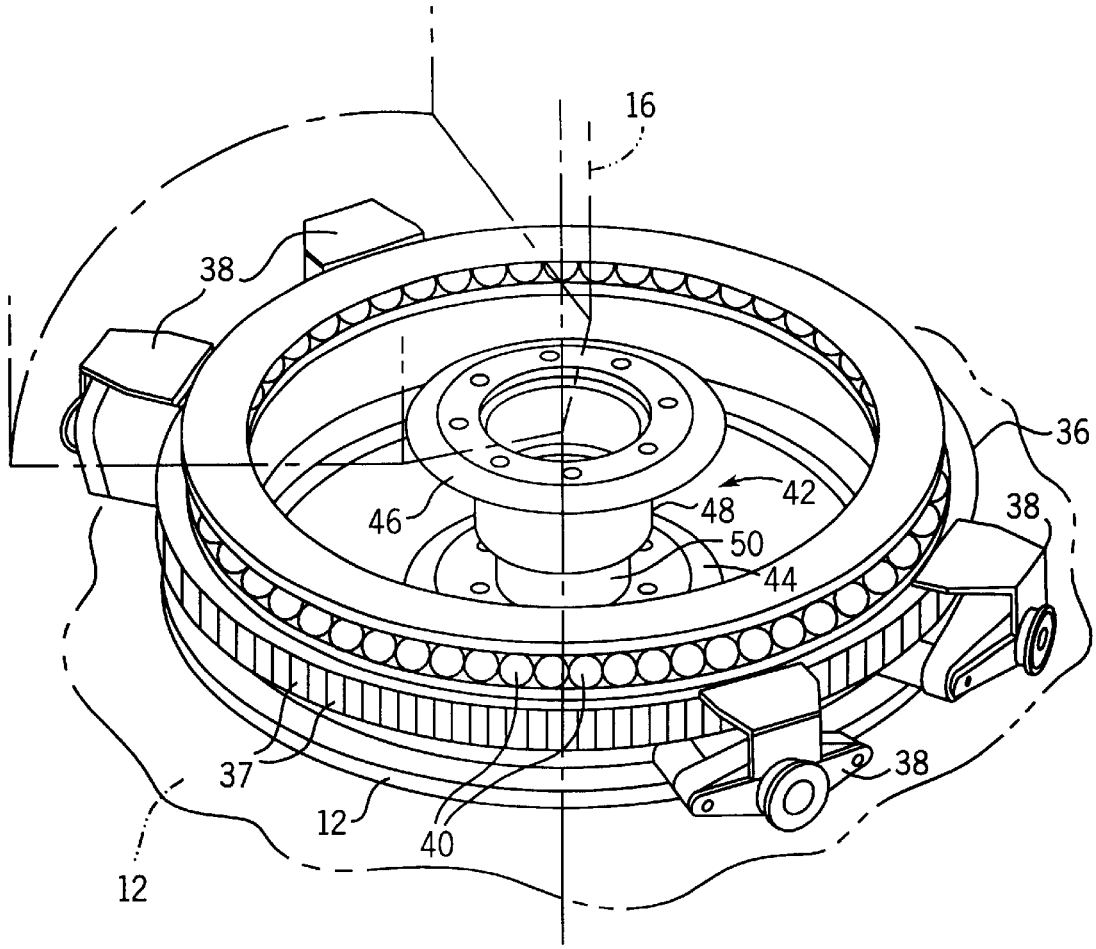
FIG. 2 is a perspective view of the base of FIG. 1 with the frame removed.
Figure 3:
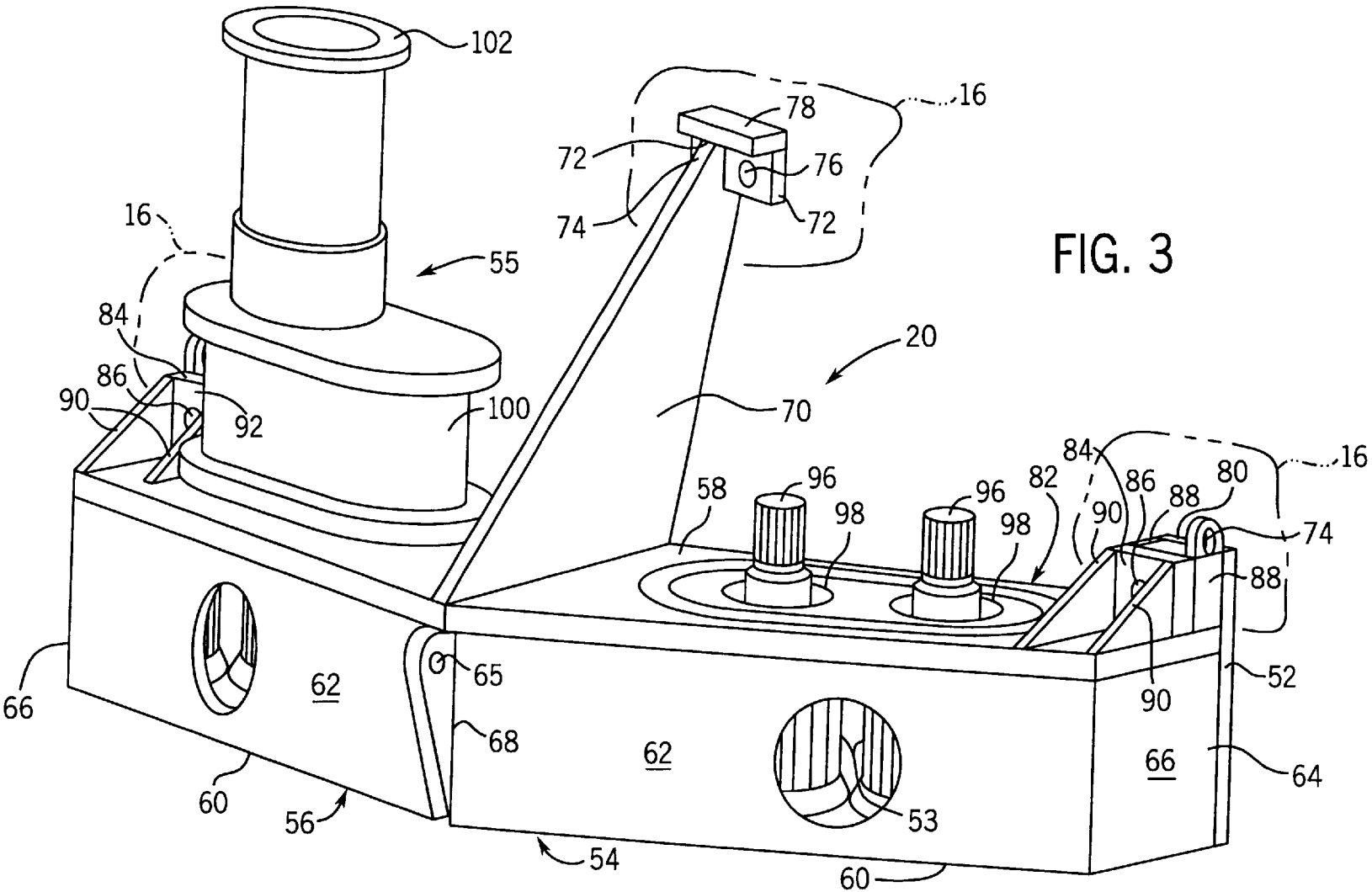
FIG. 3 is a perspective view of a partially assembled swing drive assembly.

Referring to FIGS. 2 and 3, the base 12 includes an upper surface which supports a ring gear 36. The ring gear 36 is fixed to the base 12, and has radially outwardly extending teeth 37 which engage a swing drive assembly 20 (shown in FIGS. 1, 3–5) mounted to the frame 16. The swing drive assembly 20 rotatably drive the frame 16 about the ring gear axis. Rollers 40 rotatably mounted to the frame 16 engage a top surface of the ring gear 36 to support the frame 16 above the base 12 for rotatable movement of the frame 16 relative to the base 12.

A cylindrical horizontal compensator 42, or pintle, counteracts horizontal forces exerted on the frame 16 during shovel operation. The horizontal compensator 42 has one end 44 fixed relative to the base 12 and an opposing end 46, rotatably independent of the one end 44, is fixed to the frame. The horizontal compensator 44 includes an upper cylindrical member 48 which is coaxial with a lower cylindrical member 50 and the ring gear 36. Hook rollers 38 fixed to the frame 16 engage a lower surface of the ring gear 36 to counteract vertical forces exerted on the frame 16 during shovel operation.

The swing drive assembly 20 is fixed to the frame 16, and engages the ring gear teeth 37 to rotatably drive the frame 16 about the ring gear axis relative to the base 12. The swing gear assembly 20 includes a swing girder 52 fixed to the frame, pinions 53 rotatably mounted in the swing girder 52 and engaging the ring gear teeth 37, and a drive mechanism 55 rotatably driving the pinions 53.

Figure 4:
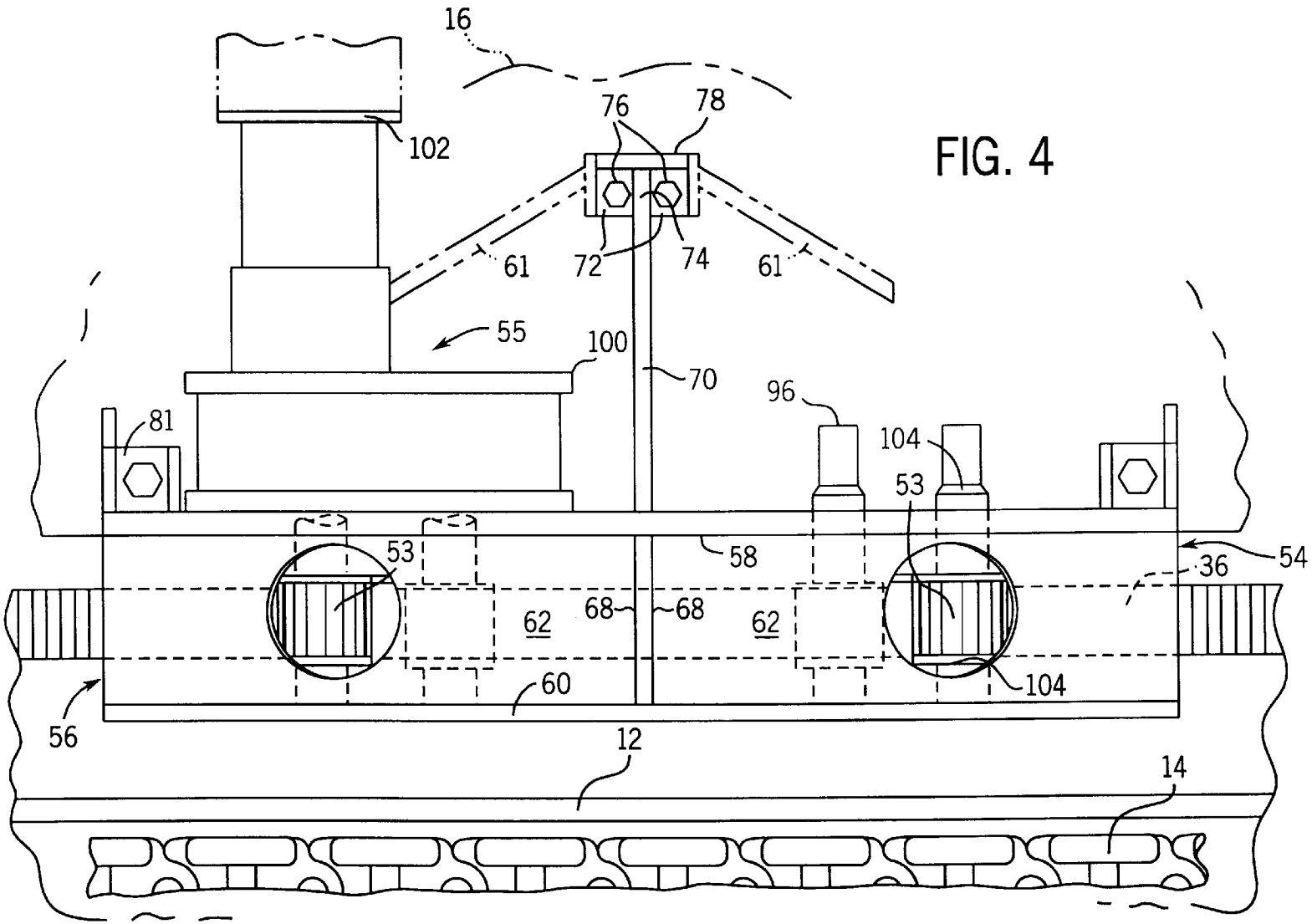
FIG. 4 is a cut away elevation view of the swing drive assembly fixed to the shovel of FIG. 1.
Figure 5:
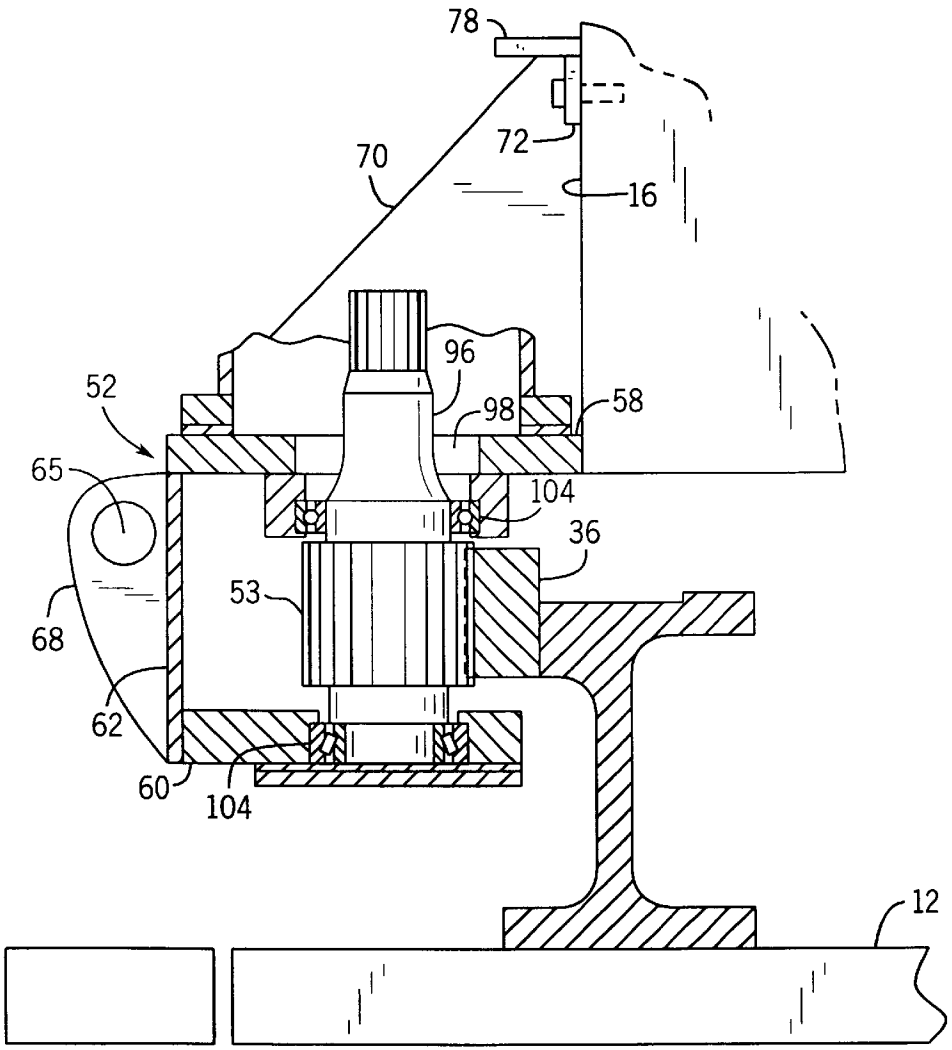
FIG. 5 is a cut away perspective view of the swing drive assembly of FIG. 4.

As shown in FIGS. 3–5, the swing girder 52 is formed from steel plate, and has a right and left side 54, 56 joined at an angle to approximate the radius of the ring gear 36. Each side 54, 56 includes a top wall 58 and bottom wall 60 joined by a back wall 62. An outer end 64 is closed by an end wall 66, and an inner end 68 is joined to the inner end 68 of the other swing girder side 54, 56. The walls 58, 60, 62, 66 define a cavity having an open front. Preferably, the top wall 58 and bottom wall 60 are single pieces of steel plate, and the back wall 62 and end walls 66 are welded to the top and bottom walls 58, 60 to form the cavity.

A strut 70 formed from steel plate extends upwardly from the junction of the two sides 54, 56, and mounting pads 72 perpendicular to the strut 70 are fixed to both sides of the strut top 74. The pads 72 abut the frame 16, and have bolt holes 76 formed therethrough for bolting the girder 52 to the frame 16 at a first attachment point. A top plate 78 fixed to the strut 70 and top edge of each pad 72 increases the structural integrity of the pads 72.

End mounting pads 80 fixed to the top wall 58 at each outer end 64 of the swing girder sides 54, 56 provide second and third attachment points for fixing the girder 52 to the frame 16. Each end mounting pad 80 is fixed to the front edge 82 of the top wall 58, and is perpendicular to the top wall 58. Each pad 80 abuts the frame 16, and has a bolt hole formed therethrough for bolting the girder 52 to the frame 16.

A guide plate 84 spaced rearwardly from each end mounting pad 80 is fixed to the top wall 58, and has a hole 86 formed therethrough which is aligned with the hole formed in the respective end mounting pad 80. Spacers 88 interposed between each end mounting pad 80 and adjacent guide plate 84 abut inwardly facing faces of each pair of end mounting pads 80 and guide plates 84. Gussets 90 fixed to the top wall 58 and an outwardly facing face 92 of each guide plate 84 support the guide plate 84. Preferably, a lifting hole 94 is formed in one of the spacers 88 at each end of the swing girder 64. Additional lifting holes 65 can be provided, such as at the junction between the girder sides, without departing from the scope of the present invention.

Bolts are inserted through the holes formed in the pads 72, 80 and guide plates 84 and corresponding holes formed in the frame 16 to bolt the swing girder 52 onto the frame 16. Preferably, the bolts are sized to withstand loading and revolving frame deflections. Most preferably, the bolts are expansion bolts having a 5 inch diameter shear connections which is expanded by an expanding member urged into the shear connections by tightening bolts. Advantageously, large wrenches are not required for installation of such an expansion bolt when tightening bolts of approximately 3 inch diameter are used.

The first, second, and third attachment points define a novel three point mounting system for attaching the swing girder 52 to the frame 16, and allows the girder 52 to flex with the frame 16 deflections. Cross bracing 61 (shown in FIG. 4) can be provided to prevent vibration during machining and to facilitate shipping without bending the strut 70. The cross bracing 61 is detachably fixed, such as by bolting, to the pads 72, 80, and is removed when the girder 52 is attached to the frame 16.

Advantageously, the three point mounting system assures alignment, as three points establish a plane. Moreover, the three point mounting system minimizes the amount of machining required prior to assembly to further simplify alignment. Prior art swing girders required machining of the entire perimeter of the girder abutting the frame. The three point mounting system only requires machining the surface of each mounting pad 72, 80 which abuts the frame 16 at each attachment point. Although, a three point mounting system is preferred, a mounting system having more than three points can be used without departing from the scope of the present invention.

The pinions 53 are rotatably mounted in the cavity, and each pinion 53 has a shaft 96 which extends through an opening 98 formed in the swing girder top wall 58. The shafts 96 and pinions 53 are driven by the drive mechanism 55 which includes a gear box 100 mounted to the top wall 58. The gear box 100 is driven by a motor (not shown) mounted to a motor flange 102, and rotatably drives both pinions 53 mounted in one of the swing girder sides 54, 56. The gearbox 100 is mounted to the swing girder top wall 58, and the motor flange 102 is mounted on the gear box 100. Bearings 104 support each shaft 96 on opposing sides of the pinion 53, and can be fixed to the top wall 58 and bottom wall 60, respectively.

Advantageously, the novel mounting system disclosed herein requires fixing only the top wall 58 and strut 70 to the frame above the frame bottom to provide a below-the-frame design. This below-the-frame design allows pinion shafts 96 which are shorter than used in the art which can be straddle-mounted (i.e. instead of being overhung from a single bearing so that the swing pinion shaft is in cantilevered bending as in past designs, the swing pinions-and-shaft is supported at both ends by bearings) to reduce shafting and bearing loading. The reduced shafting and bearing loading reduces deflections across the pinion face engaging the ring gear 36.

Another embodiment of the present invention, shown in FIGS. 6–9, is a below-the-frame swing drive assembly 120 which has more than three attachment points for attaching to the frame 16. The swing gear assembly 120 includes a swing girder 152 fixed to the frame, pinions 153 rotatably mounted in the swing girder 152 for engaging the ring gear teeth 37, and a drive mechanism 155 rotatably driving the pinions 153.

Figure 6:
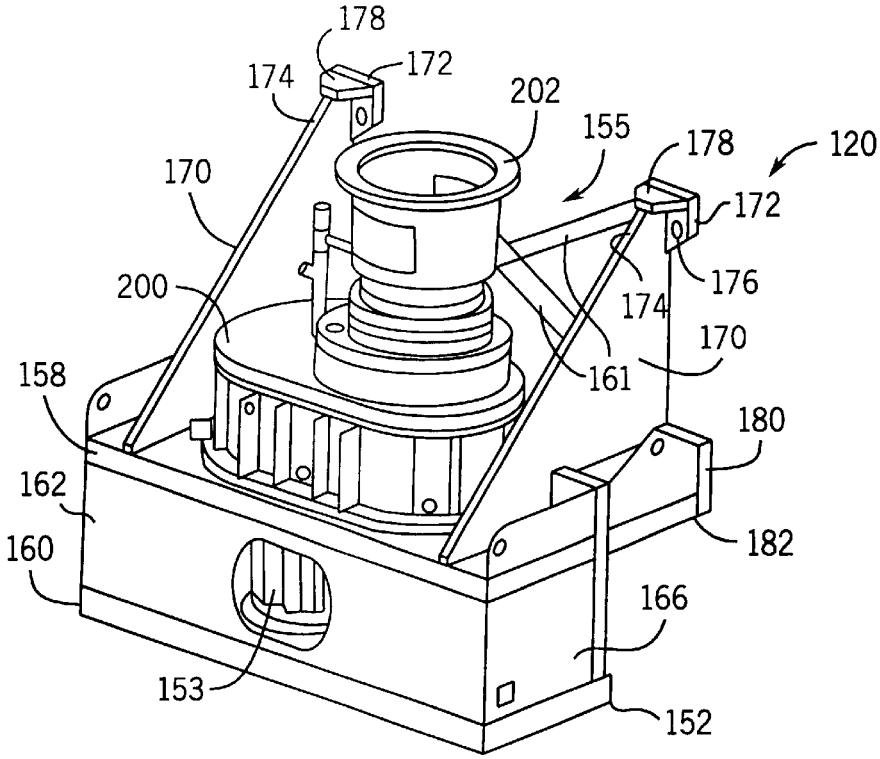
FIG. 6 is a rear perspective view of a second embodiment of swing drive assembly incorporating the present invention.
Figure 7:
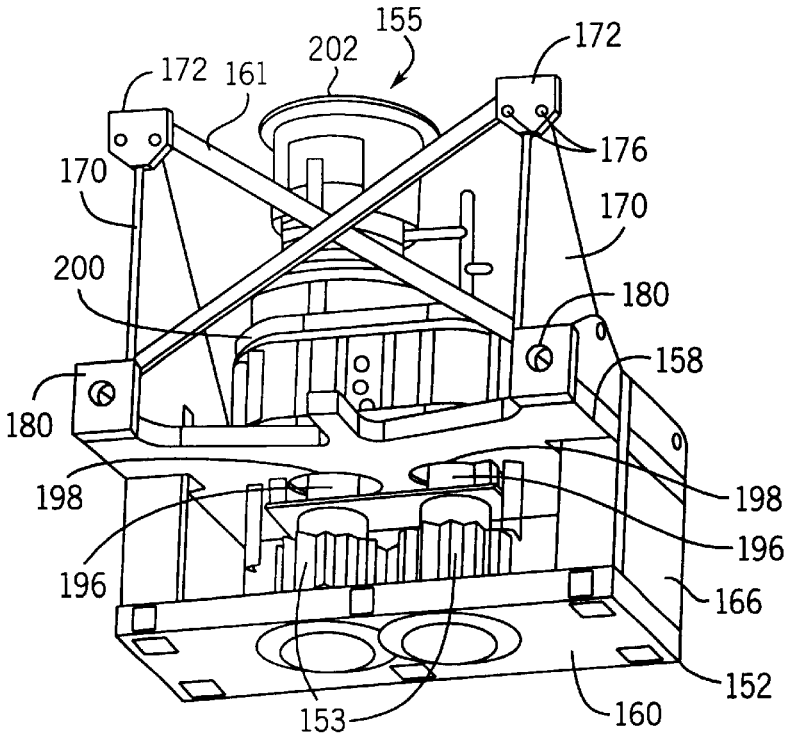
FIG. 7 is a front perspective view of the swing drive assembly of FIG. 6.

Referring to FIGS. 6 and 7, the swing girder 152 is a rectangular box formed from steel plate. The girder 152 includes a top wall 158 and bottom wall 160 joined by a back wall 162. Each end 164 of the girder 152 is closed by an end wall 166. The walls 158, 160, 162, 166 define a cavity having an open front. Preferably, the top wall 158 and bottom wall 160 are single pieces of steel plate, and the back wall 162 and end walls 166 are welded to the top and bottom walls 158, 160 to form the cavity.

A pair of struts 170 formed from steel plate extends upwardly from the top wall 158, and mounting pads 172 are fixed to each strut 170 proximal each strut top 174. The pads 172 abut the frame 16, and have bolt holes 176 formed therethrough for bolting the girder 152 to the frame 16. A top plate 178 fixed to each strut 170 and top edge of each pad 172 increases the structural integrity of the pads 172.

Top wall mounting pads 180 fixed to the top wall 158 of the swing girder 152 provide additional attachment points for fixing the girder 152 to the frame 16. Each end mounting pad 180 is fixed to the front edge 182 of the top wall 158, and is perpendicular to the top wall 158. Each pad 180 abuts the frame 16, and has a bolt hole formed therethrough for bolting the girder 152 to the frame 16.

As in the first embodiment, cross bracing 161 can be provided to prevent vibration during machining and to facilitate shipping without bending the strut 170. The cross bracing 161 is detachably fixed, such as by bolting, to the pads 172, 180, and can be removed when the girder 152 is attached to the frame 16.

Figure 9:
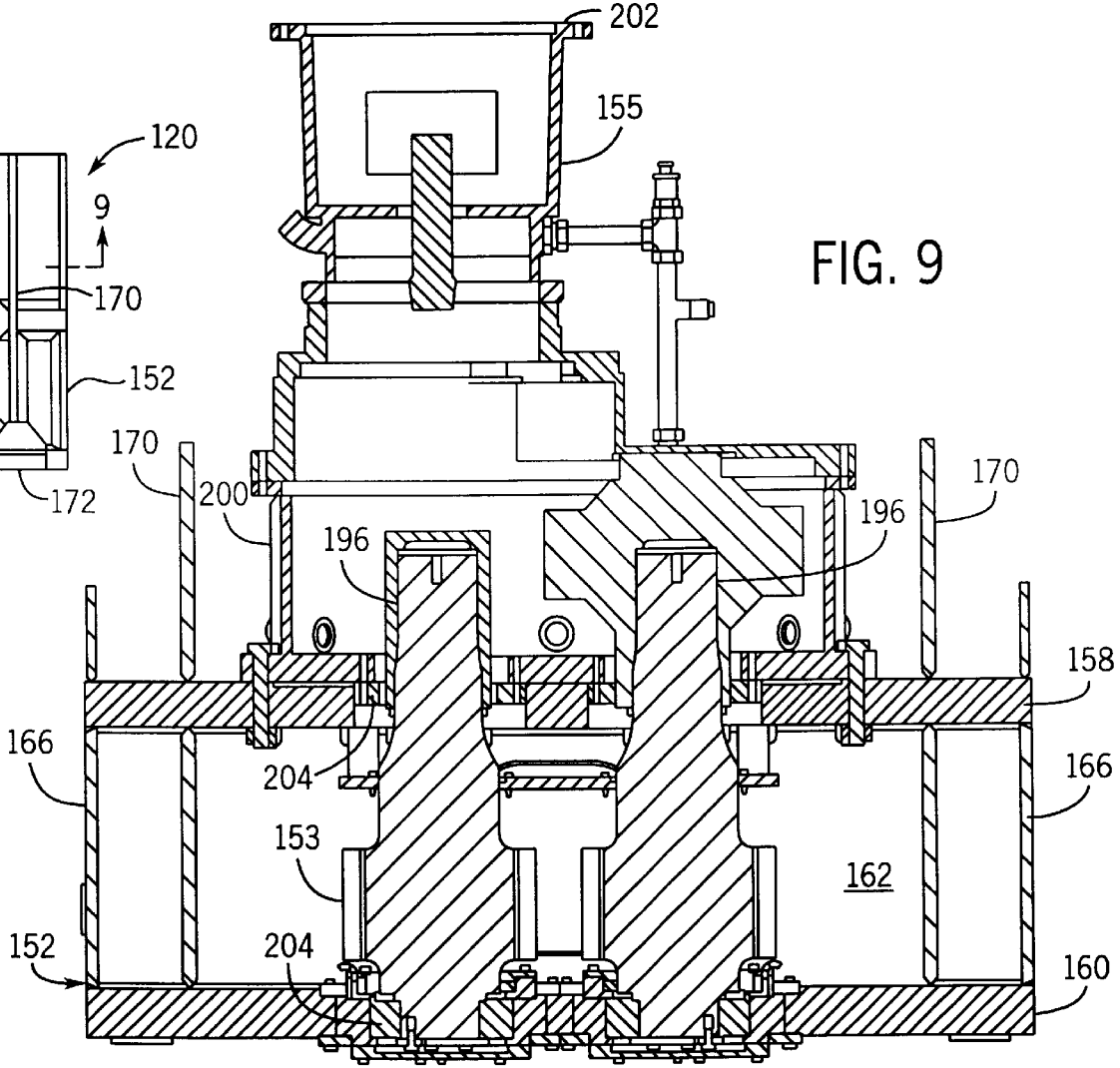
FIG. 9 is a sectional view along line 9—9 of FIG. 8.
Figure 8:
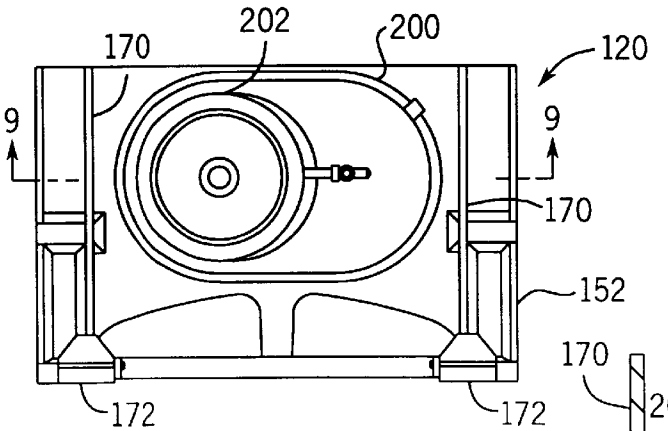
FIG. 8 is a top plan view of the swing drive assembly of FIG. 6.

Referring to FIGS. 7–9, the pinions 153 are rotatably mounted in the cavity, and each pinion 153 has a shaft 196 which extends through an opening 198 formed in the swing girder top wall 158. The shafts 196 and pinions 153 are driven by the drive mechanism 155 which includes a gear box 200 mounted to the top wall 158. The gear box 200 is driven by a motor (not shown) mounted to a motor flange 202, and rotatably drives both pinions 153 mounted in the swing girder sides 152. The gearbox 200 is mounted to the swing girder top wall 158, and the motor flange 202 is mounted on the gear box 200. Bearings 204 support each shaft 196 on opposing sides of the pinion 153, and can be fixed to the top wall 158 and bottom wall 160, respectively.

As in the first embodiment, the novel mounting system disclosed herein requires fixing only the top wall 158 and strut 170 to the frame above the frame bottom to provide a below-the-frame design. This below-the-frame design allows pinion shafts 196 which are shorter than used in the art which can be straddle-mounted (i.e. instead of being overhung from a single bearing so that the swing pinion shaft is in cantilevered bending as in past designs, the swing pinions-and-shaft is supported at both ends by bearings) to reduce shafting and bearing loading. The reduced shafting and bearing loading reduces deflections across the pinion face engaging the ring gear 36.

While there has been shown and described what are at present considered the preferred embodiments of the invention, it will be obvious to those skilled in the art that various changes and modifications can be made therein without departing from the scope of the invention defined by the appended claims.

What is claimed is:

1. A swing drive assembly for use with a mining shovel having a frame rotatable relative to a base, wherein said swing drive assembly rotatably drives the mining shovel frame relative to the mining shovel base, said assembly comprising:

a swing girder having a top wall and bottom wall joined by a back wall;

at least one strut having a top end extending upwardly from said top wall;

an attachment point proximal said strut top end for attaching the swing drive assembly to the frame;

at least one attachment point proximal one end of said top wall for attaching the swing drive assembly to the frame; and at least one attachment point proximal an opposing end of said top wall for fixing the swing drive assembly to the frame, wherein said girder is fixable to a mining shovel frame at each of said attachment points.

2. The swing drive assembly as in claim 1, in which each of said attachment points includes at least one mounting pad having a face which abuts the mining shovel frame.

3. The swing drive assembly as in claim 1, in which bolt holes are formed in said attachment points, and said swing girder is fixed to the mining shovel frame with bolts inserted through said bolt holes.

4. The swing drive assembly as in claim 1, in which at least one of said attachment points proximal an end of said top wall is disposed above said top wall.

5. The swing drive assembly as in claim 1, in which a pinion is rotatably mounted between said top wall and said bottom wall.

6. The swing drive assembly as in claim 5, in which said pinion is supported by a pinion shaft rotatably mounted between said top wall and said bottom wall, and said shaft is supported by a bearing on each end of said pinion.

7. A mining shovel comprising:

a base;

a ring gear fixed to said base, and having a gear ring axis;

a frame mounted above said base, and rotatable about said ring gear axis;

a swing girder having a top member fixed to said frame and a bottom member extending below said frame;

a pinion rotatably mounted between said top and bottom member, and engaging said ring gear to rotatably drive said frame about said ring gear axis.

8. A mining shovel as in claim 7, in which said pinion is supported by a pinion shaft rotatably mounted between said top member and said bottom member, and said shaft is supported by a bearing on each end of said pinion.

9. The mining shovel as in claim 7, in which at least one strut is fixed to said swing girder, said strut having a top end which extends upwardly from said top member and is fixed to said frame at an attachment point proximal said strut top end.

10. The mining shovel as in claim 9, in which said swing girder is fixed to said frame at an attachment point proximal one end of said top member and an attachment point proximal an opposing end of said top member.

11. The mining shovel as in claim 10, in which each of said attachment points includes at lease one mounting pad having a face which abuts the mining shovel frame.

12. The mining shovel as in claim 10, in which bolt holes are formed in at least one of said attachment points, and said swing girder is fixed to said frame with bolts inserted through said bolt holes.

13. The mining shovel as in claim 10, in which at least one of said second attachment points proximal an end of said top wall is disposed above said top wall.

14. The mining shovel as in claim 10, in which said swing girder is fixed to said frame by only said three attachment points.

15. A method of mounting a swing drive assembly to a frame rotatably mounted above a base, wherein said swing drive assembly engages a ring gear fixed to said base to rotatably drive said frame, said method comprising:

fixing a first swing drive assembly attachment point disposed above a lower member of the swing drive assembly to the frame;

fixing a second swing drive assembly attachment point disposed above a lower member of the swing drive assembly to the frame; and fixing a third swing drive assembly attachment point disposed above said first and second attachment points to the frame, wherein the lower member of the swing drive assembly is disposed below the frame, and a pinion supported by the lower member engages the ring gear.

16. The method as in claim 15, in which at least one of said attachment point are fixed to the frame by bolting.

17. The method as in claim 15, in which at least one of said attachment points is machined to provide a flat surface for abutting the frame.

18. The method as in claim 15, including fixing at least one additional swing drive assembly attachment point to the frame.

* * * * *